US012110781B2

(12) United States Patent
Young et al.

(10) Patent No.: US 12,110,781 B2
(45) Date of Patent: Oct. 8, 2024

(54) PILOT BORE PROFILE LOGGER

(71) Applicant: Underground Magnetics, Inc., Johnston, IA (US)

(72) Inventors: Michael Young, West Des Moines, IA (US); Yuriy Khapochkin, Johnston, IA (US)

(73) Assignee: Underground Magnetics, Inc., Johnston, IA (US)

( * ) Notice: Subject to any disclaimer, the term of this patent is extended or adjusted under 35 U.S.C. 154(b) by 0 days.

(21) Appl. No.: 17/951,948

(22) Filed: Sep. 23, 2022

(65) Prior Publication Data

US 2023/0090220 A1 Mar. 23, 2023

Related U.S. Application Data

(60) Provisional application No. 63/247,531, filed on Sep. 23, 2021.

(51) Int. Cl.
*E21B 47/0232* (2012.01)
*E21B 7/04* (2006.01)

(52) U.S. Cl.
CPC ..... *E21B 47/0232* (2020.05); *E21B 7/046* (2013.01)

(58) Field of Classification Search
CPC ..... E21B 47/0232
See application file for complete search history.

(56) References Cited

U.S. PATENT DOCUMENTS

2004/0134686 A1* 7/2004 Burrows ..... E21B 47/024 175/45
2007/0012483 A1 1/2007 Self et al.
2010/0243326 A1 9/2010 Jin et al.
2012/0232800 A1 9/2012 Overby et al.
2013/0176137 A1* 7/2013 Kolpack ..... E21B 47/13 340/854.3
2017/0089140 A1* 3/2017 Shaw ..... E21B 47/13
2017/0335677 A1* 11/2017 Rempe ..... E21B 47/13
2021/0207438 A1 7/2021 Shaw et al.
2021/0262338 A1 8/2021 Hall

OTHER PUBLICATIONS

International Search Report and Written Opinion for Applicaton No. PCT/US2022/044604, dated Jan. 12, 2023.

* cited by examiner

*Primary Examiner* — Giovanna Wright
(74) *Attorney, Agent, or Firm* — Mallory M. Henninger; Advent, LLP

(57) ABSTRACT

In an embodiment, the present system can primarily determine the pilot bore profile of a horizontal directional drill (HDD) based on the number of rod sections added and the pitch reading from the underground transmitter at the front of the drill string (as communicated to the HDD drill rig via the walk-over locator), with such calculations being able to be made at the HDD drill rig and/or related remote display on the HDD drill rig. That is, since the length of a given rod section is known and the pitch readout is provided by the underground transmitter, the change in the overall depth of the drill string can be calculated, for example, on drill rod to drill rod basis based on rise over run geometry. The walk-over locator can then be used for a secondary confirmation of the actual depth, if conditions permit (e.g., in range of a direct walk-over).

10 Claims, 4 Drawing Sheets

PILOT BORE PROFILE LOGGER

CROSS-REFERENCE TO RELATED APPLICATIONS

The present application claims priority under 35 U.S.C. § 119(e) of U.S. Provisional Application No. 63/247,531, filed Sep. 23, 2021, and titled "Pilot Bore Profile Logger." The foregoing U.S. Provisional Application is incorporated herein by reference in its entirety.

BACKGROUND

Directional boring, also referred to as horizontal directional drilling (HDD), is a minimal impact trenchless method of installing underground utilities such as pipe, conduit, or cables along an underground path using a surface-launched drilling rig.

DRAWINGS

The Detailed Description is described with reference to the accompanying figures. The use of the same reference numbers in different instances in the description and the figures may indicate similar or identical items.

DETAILED DESCRIPTION

Figure 1:
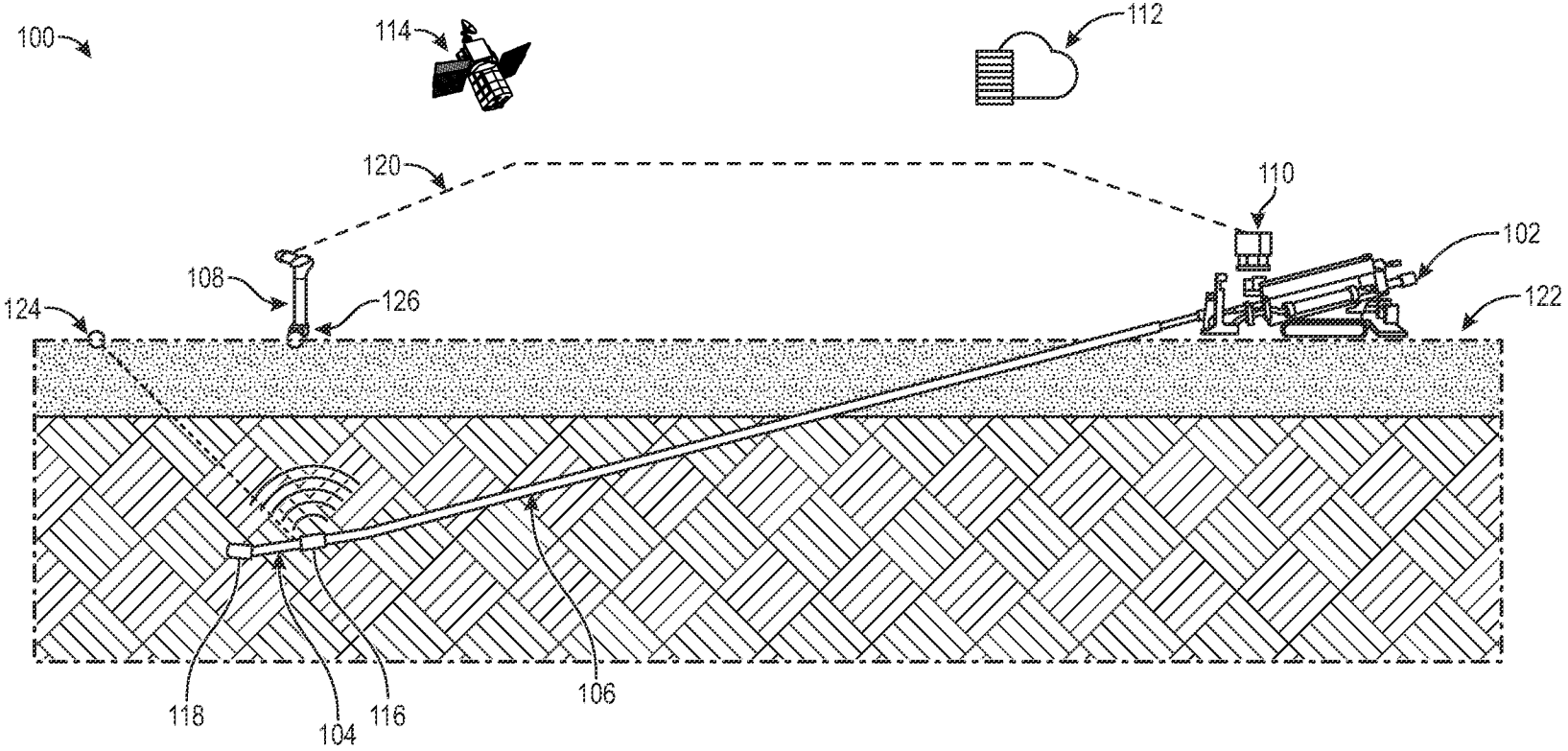
FIG. 1 is a schematic side view of a horizontal directional drilling (HDD) system, in accordance with an embodiment of the present disclosure.

Aspects of the disclosure are described more fully hereinafter with reference to the accompanying drawings, which form a part hereof, and which show, by way of illustration, example features. The features can, however, be embodied in many different forms and should not be construed as limited to the combinations set forth herein; rather, these combinations are provided so that this disclosure will be thorough and complete and will fully convey the scope.

All documents mentioned herein are hereby incorporated by reference in their entirety. References to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values herein are not intended to be limiting, referring instead individually to any and all values falling within the range, unless otherwise indicated herein, and each separate value within such a range is incorporated into the specification as if it were individually recited herein. The words "about," "approximately," or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described embodiments. The use of any and all examples, or exemplary language ("e.g.," "such as," or the like) provided herein, is intended merely to better illuminate the embodiments and does not pose a limitation on the scope of the embodiments. No language in the specification should be construed as indicating any unclaimed element as essential to the practice of the embodiments.

Before describing in detail embodiments that are in accordance with the systems and methods disclosed herein, it should be observed that embodiments include combinations of method steps and/or system components. Accordingly, the system components and method steps have been represented where appropriate by conventional symbols in the drawings, showing only those specific details that are pertinent to understanding the embodiments of the systems and methods disclosed herein so as not to obscure the disclosure with details that will be readily apparent to those of ordinary skill in the art having the benefit of the description herein.

In the following description, it is understood that terms such as "first," "second," "top," "bottom," "up," "down," and the like, are words of convenience and are not to be construed as limiting terms.

Overview

Utility lines for water, electricity, gas, telephone, and cable television are often run underground for reasons of safety and aesthetics. In many situations, the underground utilities can be buried in a trench which is then back-filled. Although useful in areas of new construction, the burial of utilities in a trench has certain disadvantages. In areas supporting existing construction, a trench can cause serious disturbance to structures or roadways. Further, there is a high probability that digging a trench may damage previously buried utilities, and that structures or roadways disturbed by digging the trench are rarely restored to their original condition. Also, an open trench may pose a danger of injury to workers and passersby.

The general technique of boring a horizontal underground hole has recently been developed to overcome the disadvantages described above, as well as others unaddressed when employing conventional trenching techniques. In accordance with such a general horizontal boring technique, also known as horizontal directional drilling (HDD) or trenchless underground boring, a boring system is situated on the ground surface and drills a hole into the ground at an oblique angle with respect to the ground surface, thus beginning a pilot bore. A drilling fluid is typically flowed through the drill string, over the boring tool, and back up the borehole to remove cuttings and dirt. After the boring tool reaches a desired depth, the tool is then directed along a substantially horizontal path to create a horizontal borehole portion of the pilot bore. After the desired length of borehole has been obtained, the tool is then directed upwards to break through to the terrain's surface, completing the pilot bore. A reamer is then attached to the drill string which is pulled back through the borehole, thus reaming out the borehole to a larger diameter.

In a traditional HDD installation, a pilot bore profile can be required as part of the completion of the utility installation. The content of the bore profile usually includes a drill rod number (i.e., an identifying number assigned to each drill rod), a pitch corresponding to each drill rod number, and a depth measured between an underground transmitter located in a distal end of a drill string (composed of one or more drill rods) and a surface level point located directly above the transmitter. After the insertion of each drill rod into the terrain, a locator operator communicates with an HDD drilling rig operator that the corresponding drill rod has been inserted, the locator operator locates the underground transmitter, and the HDD drilling rig operator records the bore profile content. The operator usually needs to specifically store the data based on the availability of each content. The process can be tedious and can tend to be difficult to use. As a result, even though the method and related products have been in the market for many years, the percentage of users actually implementing it is low.

The present method and related system provide a more systematic way to log a pilot bore profile and introduce procedures to help an operator generate and use the pilot bore profile more effectively. In an embodiment, the system can primarily determine the pilot bore profile based on the number of drill rods added and the pitch reading from the underground transmitter at the front of the drill string (as communicated to the HDD drill rig via the walk-over locator), with such calculations being able to be made at the HDD drill rig and/or related remote display on the HDD drill rig. The overall depth of the drill string can be determined on a drill rod-to-drill rod basis based on a trigonometric calculation using the lengths of each drill rod and the pitch readout provided by the underground transmitter. The walk-over locator can then be used for a secondary confirmation of the actual depth, if conditions permit (e.g., in range of a direct walk-over).

In an embodiment, in case of a discrepancy between the calculated depth (e.g., via drill rod length and pitch) and the measured depth, the calculated depth may be more reliable (e.g., drilling at larger depths; drilling under brackish or high-iron content water; or drilling in other situations where magnetic interference may exist). The present system can permit accurate pilot bore logging even if conditions do not warrant accurate depth measurement via direct use of the walk-over locator (e.g., surface obstruction; and/or magnetic interference between drill head/underground transmitter and the walk-over locator).

In an embodiment, the present bore profile logger can include multiple features. The bore profile logger can include a display unit carried on the HDD drilling rig giving an HDD operator ability to issue operation commands and operate on a pilot bore record. The bore profile logger can further include a radio frequency (RF) communication link to send and receive operation commands and information to and from an HDD locator (e.g., in communication with the display unit). The HDD locator and the remote display can be configured to display the pilot bore profile (e.g., in real-time or near real-time as it is generated). The HDD locator can receive information from an underground transmitter (e.g., associated with the drill head) and locate the underground transmitter position based, for example, on the magnetic signal send from the underground transmitter. The HDD locator can include a processor (e.g., a microprocessor) programmed with an algorithm that can use the drill rod pitches and drill rod numbers to calculate the pilot bore profile. The HDD locator and/or the remote display may be configured to communicate a recorded pilot bore profile to a specific file server (e.g., a cloud server or a mainframe server).

In an embodiment, the logging of a pilot bore profile can be achieved via a series of steps. At the beginning of an installation, an operator can generate a bore "job" with an app either on locator or the remote display. The operator can also specify a drill rod length of a first drill rod entering the ground. After insertion of each drill rod into the ground, the HDD operator can issue a command via the remote display to record a drill rod number associated with the inserted drill rod. The number is increased as each command is issued. The current rod number can be displayed on the remote display on the HDD drilling rig. At the moment a drill rod number is increased, the transmitter pitch can be recorded along with the drill rod number in a bore profile storage. The current rod number can be sent from the remote display to the HDD locator via the RF link, with the HDD locator being laterally close to the underground transmitter. When the HDD locator receives a new drill rod number, it can indicate to the locator operator to find either a locating point (a point on the ground surface that has a special spatial relation with the transmitter) or the point right over the transmitter. At either point, the measured depth and/or GNSS (global navigation satellite system) location information can be added to the bore profile storage at the remote display via the RF link (i.e., synchronized ("synced") with the pilot bore path generated at the remote display). It can also confirm to the HDD operator locating and data logging are completed for this rod number. This step of including such additional depth and/or GNSS information can be optional. Without this step, a basic bore profile can be logged. Based on the drill rod number, drill rod length, and pitches stored, a depth from a level line can be calculated at the remote display and be displayed at both remote display and locator. Such steps (beyond the beginning one) can be repeated for each drill rod added to a given drill string until the pilot bore is complete. The pilot bore data can be stored and/or transmitted (e.g., saved and/or sent) at the remote display.

Example Embodiments

Figure 2:
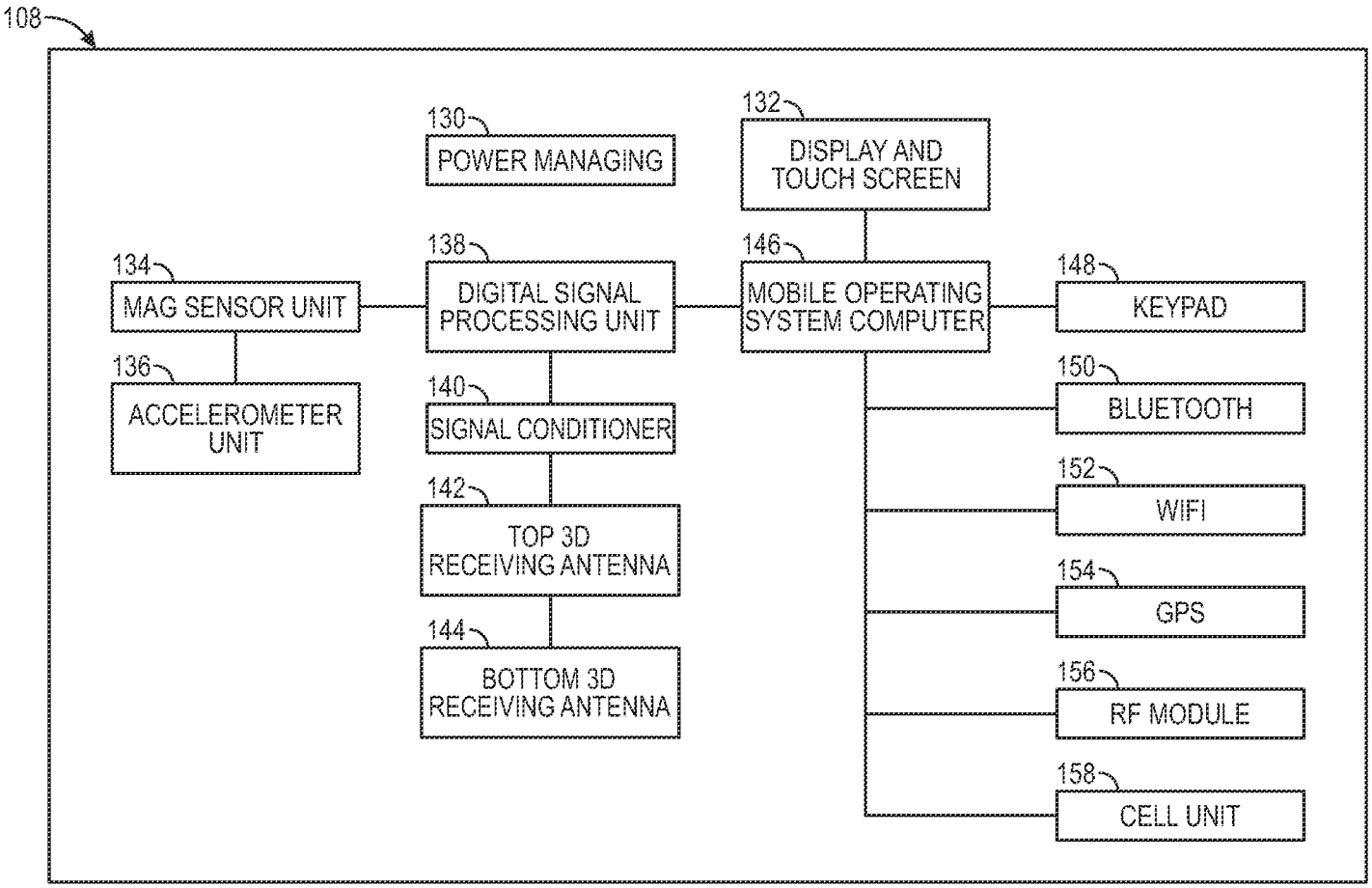
FIG. 2 is a schematic representation of the walk-over locator shown in FIG. 1.
Figure 3:
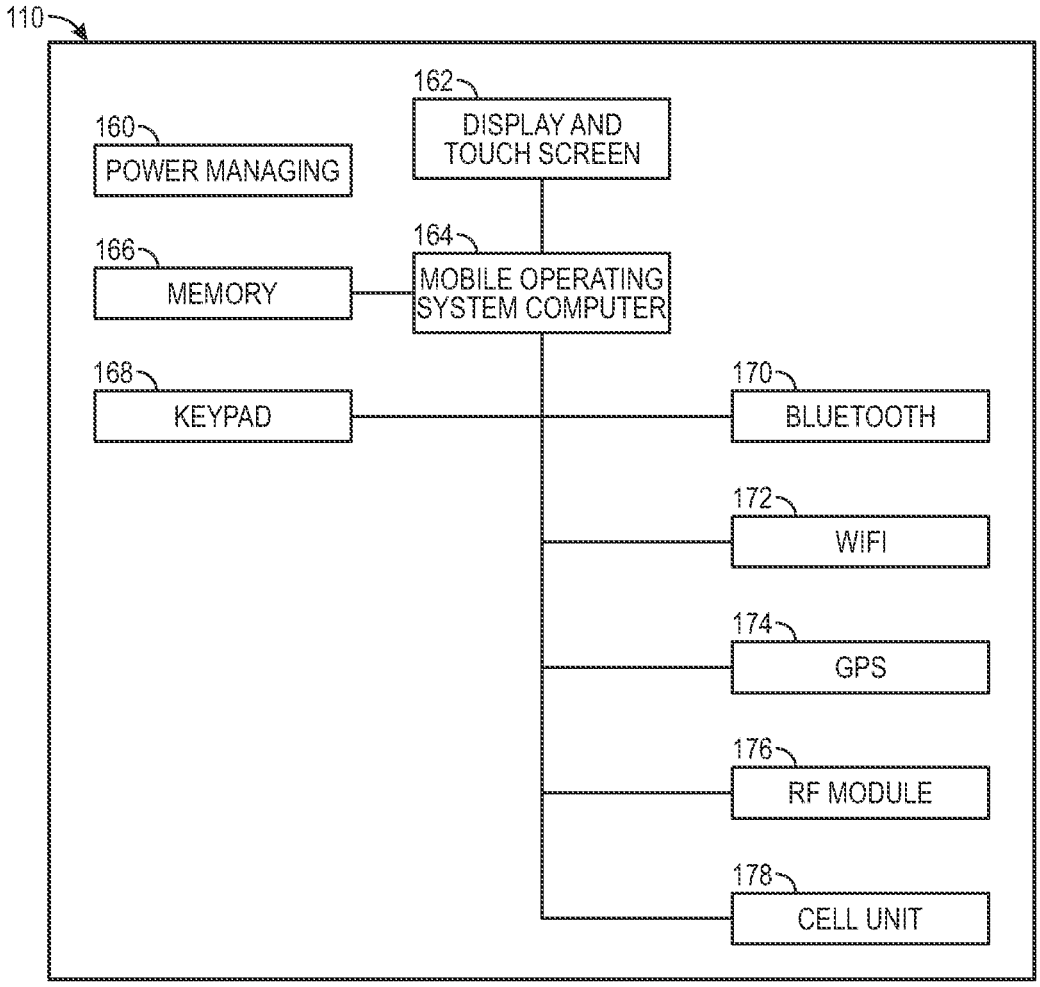
FIG. 3 is a schematic representation of the remote display shown in FIG. 1.

FIGS. 1-3 together illustrate a horizontal directional drilling (HDD) system 100, in accordance with the present disclosure. FIG. 1 illustrates the HDD system 100 in use in a drilling operation through a terrain 122, and the HDD system 100 can include an HDD drilling rig 102, a drill head 104, a drill string 106 (i.e., made up of a plurality of interconnected drill rods (not individually labeled)), a walk-over locator 108 (i.e., HDD locator), a remote display 110, and a server 112 (e.g., a cloud server), with communications optionally facilitated by a satellite 114 or a cellular data network either directly or via dedicated wifi hotspot or cellphone. The drill head 104 can be operatively coupled to and carried by an end of the drill string 106 opposite the HDD drilling rig 102. The end of the drill string 106 opposite the drill head 104 can, in turn, be operatively coupled to the HDD drilling rig 102. The drill head 104 can thereby be driven and/or rotated by the HDD drilling rig 102 via the drill string 106. The drill head 104 can include an underground transmitter 116 (e.g., a sonde) and an oriented and/or slanted drill face 118. The underground transmitter 116 can register and wirelessly transmit various data associated with the operation of the drill head 104 (e.g., one or more of yaw, pitch, roll, acceleration, GNSS, ground temperature, ground saturation, etc., depending on the sensor capabilities associated with the drill head 104), and the oriented and/or slanted drill face 118 can facilitate the steering and/or boring action of the drill head 104. As used herein, the pitch is an angle measurement taken in reference between an orientation (e.g., a drilling direction) of the underground transmitter and a reference direction (e.g., terrain horizon, plumb line, etc.)

In an embodiment, the walk-over locator 108, for use on the terrain above the underground transmitter 116, can receive the wireless signals generated by the underground transmitter 116, thereby facilitating tracking and/or monitoring of the underground drilling process (including facilitating display of drilling data thereat). As illustrated in FIG. 1, the underground transmitter 116 can transmit one or more signals (e.g., a magnetic signal and/or another signal) to the surface, for example, to a first locating point 124 off to an angle from the underground transmitter 116 (e.g., a point on the ground surface that has a special spatial relation with the underground transmitter 116) or to a second locating point 126 directly above the underground transmitter 116. It should be understood that the wireless signals generated by the underground transmitter 116 can be configured to be transmitted omnidirectionally, substantially in all directions, or substantially towards the surface of terrain 122 such that the second locating point 126 can be any arbitrary location along terrain 122 without any directional biasing relative to the underground transmitter 116.

The walk-over locator 108 can register and process the one or more signals received from the underground transmitter 116, for example, at the first locating point 124 or the second locating point 126 and output actionable data (e.g., bore data) which may, for example, be displayed at the walk-over locator 108 and/or transmitted to the remote display 110. The walk-over locator 108 can include an on-board processor or microprocessor programmed, in part, with an algorithm using pitches and drill rod numbers to calculate the pilot bore profile. The walk-over locator 108 may communicate with the remote display 110, for example, by a radio frequency (RF) link 120. The remote display 110 (e.g., mounted or otherwise carried on the HDD rig 102) can allow the HDD operator to view the drilling data generated by the walk-over locator 108. The remote display 110 may further serve as a computer processor, an input/output location (e.g., via touchscreen or a related keyboard), and/or a communications link (e.g., for RF link 120 and/or for wireless communication with the server 112 and/or the satellite 114).

In an embodiment, as shown in FIG. 2, the walk-over locator 108 can, more particularly, include a locator power managing unit 130, a display and touch screen 132, a magnetic sensor signal unit 134, an accelerometer signal unit 136, a digital signal processing unit 138, a signal conditioner 140 (e.g., an electronic circuit that manipulates a signal in a way that prepares it for the next stage of processing), a first three-dimensional (3D) receiving antenna 142, a mobile operating system computer 146 (e.g., Android, IOS, or Linux operating system), a keypad 148, a Bluetooth short-range wireless communication unit 150, a Wi-Fi wireless communication unit 152, a GNSS unit 154, an RF communication module 156, and a cellular communication unit 158. In further embodiments, the walk-over locator 108 includes a second 3D receiving antenna 144. Such components can be electrically and/or electronically coupled (e.g., wirelessly or hard-wired) with one another as needed to operate. In an embodiment, the 3D receiving antennas 142 and 144 can be configured to receive a data signal (e.g., from the underground transmitter 116), and the signal conditioner 140 can be configured to manipulate the data signal into a form receivable by digital signal processing unit 138.

The digital signal processing unit 138 of the walk-over locator 108 can further be configured to communicate with the magnetic sensor signal unit 134 and the accelerometer signal unit 136, with the latter two units configured to manipulate the received signals to output, respectively, magnetically derived data (e.g., yaw, pitch, and roll) and accelerometer derived data as related to the orientation of the underground transmitter 116. The digital signal processing unit 138 can further be configured to communicate such derived data to the mobile operating system computer 146. The mobile operating system computer 146 of the walk-over locator 108 can have a display and touch screen 132, a keypad 148 (e.g., a full keyboard, a toggle keypad, and/or a numeric keypad), a Bluetooth short-range wireless communication unit 150, a Wi-Fi wireless communication unit 152, a GNSS unit 154, an RF communication module 156, and/or a cellular communication unit 158 operatively associated therewith to facilitate data input/output and/or communication functionality. The GNSS unit 154 can facilitate an assignment of a geolocation to the walk-over locator 108, which, in turn, can be ascribed to the position of the underground transmitter 116 when located. The walk-over locator 108 can be configured to receive at least the signal corresponding to the pitch (as well as the roll and/or yaw) of the drill head 104 and to determine the pitch (as well as the roll and/or yaw) of the drill head 104 based on the signal corresponding to the pitch thereof.

In an embodiment, as shown in FIG. 3, the remote display 110 can have a display power managing unit 160, a display and touch screen 162, a mobile operating system computer 164 (e.g., Android, IOS, or Linux operating system), a memory 166, a keypad 168 (e.g., a full keyboard, a toggle keypad, and/or a numeric keypad), a Bluetooth short-range wireless communication unit 170, a Wi-Fi wireless communication unit 172, a GNSS unit 174, an RF communication module 176, and/or a cellular communication unit 178 operatively associated therewith to facilitate data input/output and/or communication functionality. Such components can be electrically and/or electronically coupled (e.g., wirelessly or hard-wired) with one another as needed to operate. The GNSS unit 174 can facilitate an assignment of a geolocation to the remote display 110. In an embodiment, the walk-over locator 108 and the remote display 110 can wirelessly communicate with one another, such as via RF communication. For example, data collected, compiled, and/or converted by the walk-over locator 108 can be transmitted to at least the remote display 110 for use at the remote display 110 and/or storage thereat or elsewhere (e.g., cloud server 112).

In an embodiment, the system can primarily determine the pilot bore profile based on the number of drill rod sections (associated with the drill string 106) added and the pitch reading from the underground transmitter 116 at the front of the drill string 106 (as communicated to the remote display 110 via the walk-over locator 108), with such calculations being able to be made at the HDD drill rig 102 and/or related remote display 110 thereon. That is, since the length of a given drill rod section is known and the pitch readout is provided by the underground transmitter 116, the change in the overall depth of the drill string 106 and/or the lead drill rod section can be calculated, for example, on a drill rod-to-drill rod basis or on another basis (e.g., over a different chosen distance—a portion of drill rod or multiple drill rods), based on rise over run geometry or a trigonometric calculation using the lengths of each drill rod section and the pitch readout. The walk-over locator 108 can then be used for a secondary confirmation of the actual depth, if conditions permit (e.g., in range of a direct walk-over). Any data generated by the walk-over locator 108 (e.g., directly measured depth and/or GNSS location thereof can be overlaid (e.g., "synced") with the pilot bore profile logged/generated at the remote display 110. It is to be understood that this pilot bore profile logger may also be implemented in an HDD system which incorporates an in-ground telemetry system (such as that disclosed in U.S. Provisional Application No. 63/170,813 titled "Wireless Telemetry System for Horizontal Directional Drilling" and U.S. Non- Provisional patent application Ser. No. 17/483,069 titled "Wireless Telemetry System for Horizontal Directional Drilling," the contents of which are hereby incorporated by reference thereto).

Figure 4:
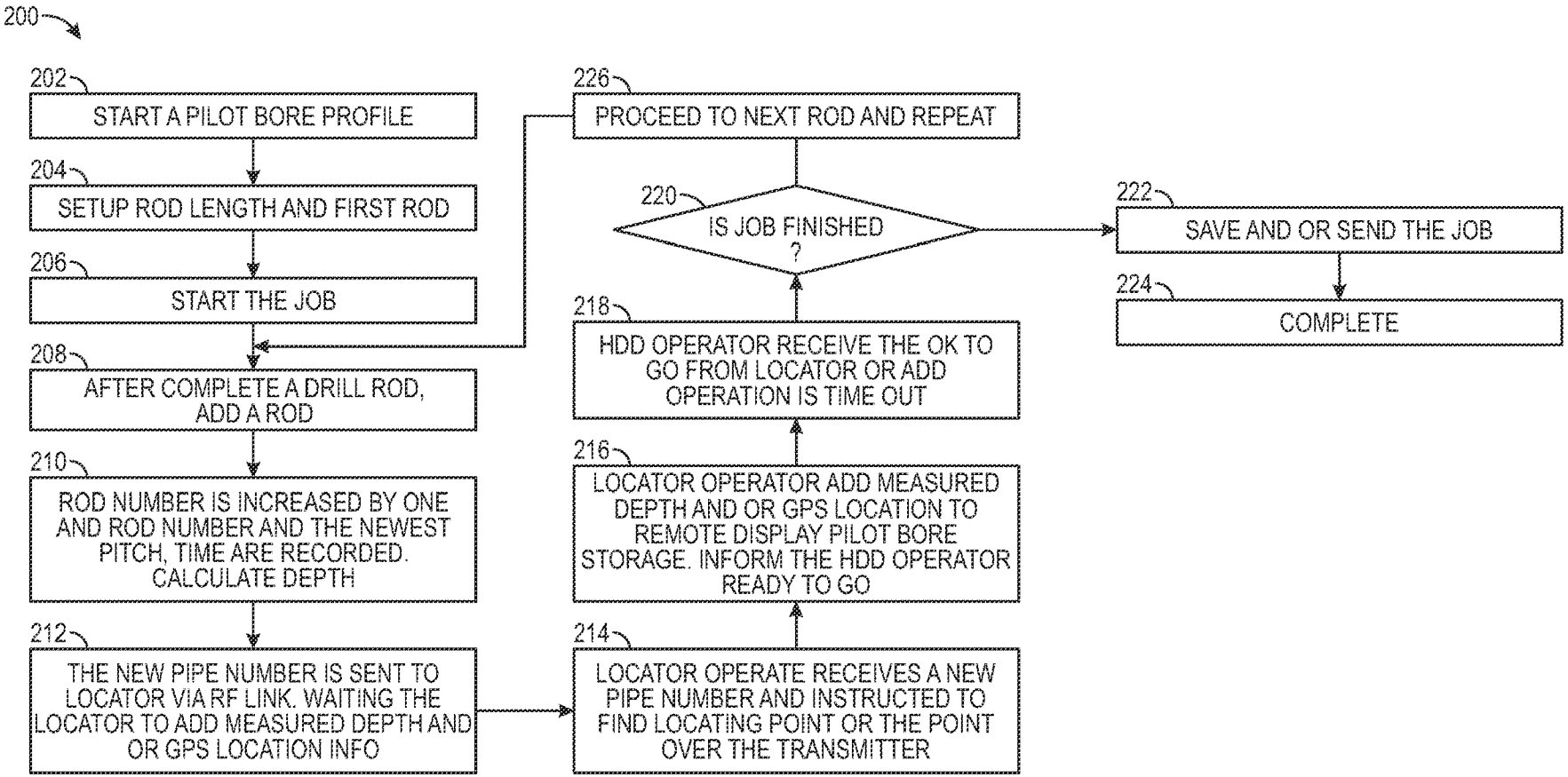
FIG. 4 is a flow diagram of a process for generating/logging a pilot bore profile using an HDD system, in accordance with an embodiment of the present disclosure.

FIG. 4 illustrates an operational process 200 (i.e., in the form of a flow chart) for generating/logging a pilot bore profile using the HDD system 100, in accordance with an embodiment of the present disclosure. The operational process 200 include a first step 202 of starting a pilot bore profile. The second step 204 is to set up the rod length and the first rod. The third step 206 is to start the job (e.g., commence drilling). The fourth step 208 is, after inserting a drill rod into the terrain, add another drill rod (e.g., couple another drill rod to the prior drill rod, such as via screw-threading, and proceed to drill and insert the length of the added drill rod into the terrain). The fifth step 210 is to increase the drill rod number by one (i.e., upon attachment of the rod to the drill string); record the drill rod number, the newest pitch, and time of addition; and calculate the depth (e.g., depth change based on the rod length and pitch). The sixth step 212 is to send the recorded drill rod number to the walk-over locator 108; and to wait for the walk-over locator 108 to add the measured depth and/or GNSS location information to the record. The seventh step 214 is for the locator operator to receive a new drill rod number and to be instructed to find the first locating point 124 (i.e., a chosen point laterally offset from the underground transmitter 116) or the second locating point 126 (i.e., a point over the underground transmitter 116). The eighth step 216 is for the locator operator to add a measured depth and/or a GNSS location to the remote display pilot bore storage; and to inform the HDD operator of being ready to proceed with the next drill rod. (In some embodiments, the sixth step 212 through the eighth step 216 may be optional or may not even be possible to achieve due to a surface obstruction, and such situations are within the scope of this disclosure.) The ninth step 218 is for the HDD operator to receive the okay to go (i.e., proceed to step 226) from the locator operator and/or the walk-over locator 108 or to add the operation is timed out (i.e., a period of inactivity exceeds a predetermined amount of time). The tenth step 220 is to decide whether the job is finished. If decided that the job is finished, the eleventh step 222 is to save and/or send the job (i.e., the pilot bore profile and any other saved data related to the drilling), and the twelfth step 224 is to deem the job complete. If decided that the job is NOT finished, the alternate eleventh step 226 is to proceed to a next drill rod and repeat steps 208-220.

The HDD system 100 may be controlled by one or more computing systems (e.g., 138, 146, 164) having a processor configured to execute computer readable program instructions (i.e., the control logic) from a non-transitory carrier medium (e.g., storage medium such as a flash drive, solid-state disk drive, SD card, or the like). The one or more computing systems can be connected to various components of the HDD system, either by direct connection, or through one or more network connections (e.g., local area networking (LAN), controller area network (CAN), etc.), wireless area networking (WAN or WLAN), one or more hub connections (e.g., USB hubs), and so forth). For example, the one or more computing systems can be communicatively coupled (e.g., hard-wired or wirelessly) to at least a portion of the electronically controllable elements of the HDD system 100. The program instructions, when executing by the processor, can cause the computing system to control the HDD system 100. In an implementation, the program instructions form at least a portion of software programs for execution by the processor.

The processor provides processing functionality for the computing system and may include any number of processors, micro-controllers, or other processing systems, and resident or external memory for storing data and other information accessed or generated by the computing system. The processor is not limited by the materials from which it is formed or the processing mechanisms employed therein.

The non-transitory carrier medium is an example of device-readable storage media that provides storage functionality to store various data associated with the operation of the computing system, such as a software program, code segments, or program instructions, or other data to instruct the processor and other elements of the computing system to perform the techniques described herein. The carrier medium may be integral with the processor, stand-alone memory, or a combination of both. The carrier medium may include, for example, removable and non-removable memory elements such as RAM, ROM, Flash (e.g., SD Card, mini-SD card, micro-SD Card), magnetic, optical, USB memory devices, and so forth. In embodiments of the computing system, the carrier medium may include removable ICC (Integrated Circuit Card) memory such as provided by SIM (Subscriber Identity Module) cards, USIM (Universal Subscriber Identity Module) cards, UICC (Universal Integrated Circuit Cards), and so on.

Each computing system can include one or more displays (e.g., 132, 162) to display information to a user of the computing system. In embodiments, the display may comprise an LED (Light Emitting Diode) display, an OLED (Organic LED) display, an LCD (Liquid Crystal Diode) display, a TFT (Thin Film Transistor) LCD display, an LEP (Light Emitting Polymer), or PLED (Polymer Light Emitting Diode) display, and so forth, configured to display text and/or graphical information such as a graphical user interface. The display may be backlit via a backlight such that it may be viewed in the dark or other low-light environments. The display may be provided with a touch screen to receive input (e.g., data, commands, etc.) from a user. For example, a user may operate a given computing system by touching the touch screen and/or by performing gestures on the touch screen. In some embodiments, the touch screen may be a capacitive touch screen, a resistive touch screen, an infrared touch screen, combinations thereof, and the like. The computing system may further include one or more input/output (I/O) devices (e.g., a keypad, buttons, a wireless input device, a thumbwheel input device, a trackstick input device, and so on). The I/O devices may include one or more audio I/O devices, such as a microphone, speakers, and so on.

Each computing system may also include a communication module representative of communication functionality to permit computing device to send/receive data between different devices (e.g., components/peripherals) and/or over the one or more networks. The communication module may be representative of a variety of communication components and functionality including, but not necessarily limited to: a browser; a transmitter and/or receiver; data ports; software interfaces and drivers; networking interfaces; data processing components; and so forth.

The one or more networks are representative of a variety of different communication pathways and network connections which may be employed, individually or in combinations, to communicate among the components of the given unit (e.g., 108, 110) of the HDD system 100. Thus, the one or more networks may be representative of communication pathways achieved using a single network or multiple networks. Further, the one or more networks are representative of a variety of different types of networks and connections that are contemplated including, but not necessarily limited to: the Internet; an intranet; a Personal Area Network (PAN); a Local Area Network (LAN) (e.g., Ethernet); a Wide Area Network (WAN); a satellite network; a cellular network; a mobile data network; wired and/or wireless connections; and so forth. Examples of wireless networks include but are not necessarily limited to: networks configured for communications according to: one or more standard of the Institute of Electrical and Electronics Engineers (IEEE), such as 802.11 or 802.16 (Wi-Max) standards; Wi-Fi standards promulgated by the Wi-Fi Alliance; Bluetooth standards promulgated by the Bluetooth Special Interest Group; and so on. Wired communications are also contemplated such as through Universal Serial Bus (USB), Ethernet, serial connections, and so forth.

Each computing system is described can include a user interface, which is storable in memory (e.g., the carrier medium) and executable by the processor. The user interface is representative of functionality to control the display of information and data to the user of the computing system via the display. In some implementations, the display may not be integrated into the computing system and may instead be connected externally using a universal serial bus (USB), Ethernet, serial connections, and so forth. The user interface may provide functionality to allow the user to interact with one or more applications of the computing system by providing inputs via the touch screen and/or the I/O devices. For example, the user interface may cause an application programming interface (API) to be generated to expose functionality to an online module to configure the application for display by the display or in combination with another display. In embodiments, the API may further expose functionality to configure a control module to allow the user to interact with an application by providing inputs via the touch screen and/or the I/O devices.

In implementations, the user interface may include a browser. The browser enables the computing device to display and interact with content such as a webpage within the World Wide Web, a webpage provided by a web server in a private network, and so forth. The browser may be configured in a variety of ways. The browser may be a web browser suitable for use by a full resource device with substantial memory and processor resources (e.g., a smart phone, a personal digital assistant (PDA), etc.).

Generally, any of the functions described herein can be implemented using software, firmware, hardware (e.g., fixed logic circuitry), manual processing, or a combination of these implementations. The terms "module" and "functionality" as used herein generally represent software, firmware, hardware, or a combination thereof. The communication between components in the given parts (e.g., 108, 110, 116) of the HDD system 100, for example, can be wired, wireless, or some combination thereof, while communication between the components 108, 110, 116 can be achieved by any various wireless technologies (e.g., RF, Bluetooth, and/or WiFi connections). In the case of a software implementation, for instance, a module may represent executable instructions that perform specified tasks when executed on a processor, such as the processor described herein. The program code can be stored in one or more device-readable storage media, an example of which is the non-transitory carrier medium associated with the computing system.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A horizontal directional drilling (HDD) system, comprising:

an HDD drilling rig operatively coupled to a drill string, the drill string including one or more drill rods, the drill string carrying a drill head at an end thereof distal to the HDD drilling rig, the drill head configured to drill through a terrain, the drill head including an underground transmitter, the underground transmitter configured to transmit at least a signal corresponding to a pitch of the drill head;

a walk-over locator configured for use on the terrain generally above the underground transmitter, the walk-over locator configured for receiving at least the signal corresponding to the pitch of the drill head, the walk-over locator configured to determine the pitch of the drill head based on the signal, the walk-over locator configured to at least one of directly measure a first depth of the drill head or provide a Global Navigation Satellite System (GNSS) geolocation of the drill head at a given instance in the drilling process, the walk-over locator configured to relay at least one of the first depth or the GNSS geolocation of the drill head at a given instance in the drilling process; and a remote display associated with the HDD drill rig, the walk-over locator configured to communicate the pitch of the drill head to the remote display, the remote display configured to use the pitch and a length of at least one of a given drill rod or a group of drill rods to determine a second depth of the drill head at a given drilling distance, the second depth of the drill head and the GNSS geolocation being at least one of stored or displayed as part of a pilot bore profile when the first depth is unavailable or inaccurate, the pilot bore profile comprising a plot of one or more depths at one or more respective drilling distances, the remote display configured to overlay at least one of the first depth or the GNSS geolocation of the drill head and the second depth in the drilling process with the pilot bore profile.

2. The HDD system of claim 1, wherein the underground transmitter is configured to register and transmit data associated with at least one of: drill head yaw, drill head pitch, drill head roll, drill head acceleration, ground temperature, or ground saturation.

3. The HDD system of claim 1, wherein the walk-over locator and the remote display each are configured to communicate to each other via at least one of: a short-range wireless communication unit, a Wi-Fi wireless communication unit, a radio frequency (RF) unit, or a cellular communication unit.

4. The HDD system of claim 1, wherein the walk-over locator includes a global navigation satellite system (GNSS) configured to determine a geolocation of the walk-over locator.

5. The HDD system of claim 4, wherein the walk-over locator is configured to transmit the determined geolocation of the walk-over locator to the remote display.

6. The HDD system of claim 1, wherein the remote display includes a global navigation satellite system (GNSS) configured to determine a geolocation of the remote display.

7. The HDD system of claim 6, wherein the remote display is configured to transmit the determined geolocation of the remote display to the walk-over locator.

8. The HDD system of claim 1, wherein the walk-over locator includes a first three-dimensional (3D) antenna, the first 3D antenna configured to receive signals from the underground transmitter.

9. The HDD system of claim 8, wherein the walk-over locator includes a second three-dimensional (3D) antenna, the second 3D antenna configured to receive signals from the underground transmitter.

10. The HDD system of claim 1, wherein the underground transmitter is configured to transmit a magnetic signal.

* * * * *